US006137421A

United States Patent [19]

Dykema

[11] Patent Number: 6,137,421

[45] Date of Patent: Oct. 24, 2000

[54] METHOD AND APPARATUS FOR STORING A DATA ENCODED SIGNAL

[75] Inventor: Kurt A. Dykema, Holland, Mich.

[73] Assignee: Prince Corporation, Holland, Mich.

[21] Appl. No.: 09/071,210

[22] Filed: May 1, 1998

Related U.S. Application Data

[60] Provisional application No. 60/065,517, Nov. 12, 1997.

[51] Int. Cl.[7] ..... G08C 19/00

[52] U.S. Cl. ..... 340/825.69; 340/172.5; 375/279; 704/225

[58] Field of Search ..... 340/825.69, 172.5; 375/279; 704/225

[56] References Cited

U.S. PATENT DOCUMENTS

| | | |
|---|---|---|
| 5,379,453 | 1/1995 | Tigwell . |
| 5,442,340 | 8/1995 | Dykema . |
| 5,479,155 | 12/1995 | Zeinstra et al. . |
| 5,564,101 | 10/1996 | Eisfield et al. . |
| 5,583,485 | 12/1996 | Van Lente et al. . |
| 5,614,885 | 3/1997 | Van Lente et al. . |
| 5,614,891 | 3/1997 | Zeinstra et al. . |
| 5,619,190 | 4/1997 | Duckworth et al. . |
| 5,627,529 | 5/1997 | Duckworth et al. . |
| 5,646,701 | 7/1997 | Duckworth et al. . |
| 5,661,651 | 8/1997 | Geschke et al. . |
| 5,661,804 | 8/1997 | Dykema et al. . |
| 5,680,263 | 10/1997 | Zimmermann et al. . |
| 5,686,903 | 11/1997 | Duckworth et al. . |
| 5,699,054 | 12/1997 | Duckworth . |
| 5,699,055 | 12/1997 | Dykema et al. . |
| 5,841,813 | 11/1998 | van Nee ..... 375/279 |

FOREIGN PATENT DOCUMENTS

| | | |
|---|---|---|
| 1261150 | 12/1993 | Italy . |
| 9402920 | 2/1994 | WIPO . |

*Primary Examiner*—Michael Horabik
*Assistant Examiner*—Alton Hornsby
*Attorney, Agent, or Firm*—Harness, Dickey & Pierce, P.L.C.

[57] ABSTRACT

The data storing method includes the steps of: (a) receiving a data encoded signal; (b) sampling the received data encoded signal at a first sampling rate; (c) counting the number of consecutive samples at a first logic level; (d) storing the number of samples counted in step (c) in a first portion of a memory template; (e) counting the number of consecutive samples at a second logic level; (f) comparing the number of samples counted in step (e) to a threshold value; (g) changing the sampling rate at which the received data encoded signal is sampled and counting the number of consecutive samples at the second logic level if the number of samples counted in step (e) exceeds the threshold value; and (h) storing in the memory template, the number of samples counted in step (e) if the threshold was not exceeded, or the number of samples counted in step (g) if the threshold value was exceeded. The apparatus includes a processor programmed to perform the above steps. The method is well-suited for use in a trainable transmitter.

21 Claims, 7 Drawing Sheets

METHOD AND APPARATUS FOR STORING A DATA ENCODED SIGNAL

CROSS-REFERENCE TO RELATED APPLICATIONS

This application claims priority under 35 U.S.C. §119(e) on U.S. Provisional Application No. 60/065,517 entitled "Method and Apparatus for Storing Data Encoded Signal" filed on Nov. 12, 1997, by Kurt A. Dykema.

BACKGROUND OF THE INVENTION

The present invention generally relates to a method for storing a data encoded signal, and more particularly, relates to a method for storing a data code that is encoded in a signal received by a trainable transmitter such that it may be subsequently regenerated for transmittal to a controlled device.

Trainable transmitters are used to learn certain characteristics of received control signals such that the trainable transmitter may subsequently generate and transmit a signal having the learned characteristics to a remotely controlled device. Remotely controlled devices, such as garage door openers, televisions, and stereo equipment, include signal-receiving circuitry that looks for specific signal characteristics in a signal received from the original transmitter that is typically purchased with the remotely controlled device. If the receiving circuitry receives a signal that does not include these characteristics, the receiving circuitry will not respond to the signal.

The characteristics that a trainable transmitter must learn to effectively mimic the original transmitter depends upon the characteristics that the remotely controlled device looks for in a received signal when determining whether or not to respond to the received signal by performing a predetermined action. For example, universal remote control transmitters of the type used to control household audio and visual equipment must be capable of detecting an infrared (IR) light beam and subsequently learning the characteristics of the data code that is modulated onto the IR light beam. Such characteristics typically include the sequence of binary logic data (0's and 1's) as well as the duration and frequency of the bit pulses representing the binary data.

Radio frequency (RF) trainable transmitters are known and used for learning the characteristics of an RF signal transmitted by a garage door remote control transmitter and for generating and transmitting an RF signal including those characteristics to a garage door opening mechanism. Examples of such RF trainable transmitters are disclosed in U.S. Pat. Nos. 5,442,340; 5,479,155; 5,583,485; 5,614,885; 5,614,891; 5,627,529; 5,661,804; 5,686,903; and 5,708,415. RF trainable transmitters of the type disclosed in these patents differ from the IR trainable transmitters used to control household electronic equipment in that the carrier frequency of the transmitted RF carrier signal may vary significantly from one system to another. Further, the receivers of the devices controlled using such RF control signals are typically finely tuned to receive an RF signal having a particular carrier frequency. Therefore, RF trainable transmitters of this type must not only learn the same characteristics of the data code as an IR trainable transmitter, but they must also learn the carrier frequency of the RF carrier signal.

Both RF and IR trainable transmitters typically include a plurality of "channels" for storing the characteristics of a plurality of signals. Each signal is typically associated with a user-actuated switch so that a user selects a particular one of the learned signals for the trainable transmitter by activating the associated switch. To enable the trainable transmitter to learn the signal characteristics of various signals of different length and duration, the amount of memory provided and allocated within the trainable transmitter for each of its channels must be of sufficient size to store the characteristics of the longest known signal of which the trainable transmitter may be expected to learn. Consequently, the greater the number of channels provided in the trainable transmitter, the greater the size of memory that is required. Further, if a manufacturer of an original remote control transmitter and corresponding receiver constructs a system to utilize data codes of lengths greater than any previously existing system, the size of memory allocated per channel must increase accordingly for the trainable transmitter to learn such data codes and thus be truly "universal."

The RF trainable transmitters described in the above-identified patents first identify the carrier frequency of a received RF signal and demodulate the signal using a reference signal having a frequency related to the carrier frequency of the received RF signal. The demodulated data signal is sampled at a relatively high sampling interval (approximately 68 $\mu$sec) to produce a digitized data stream representing the data signal. This digitized data stream is stored in the random access memory (RAM) of a microprocessor until the RAM has been filled with data. The processor then analyzes the digitized data stream to detect the beginning and end points of a transmitted data code word by looking for repetitions of data patterns within the data stream that fills the RAM. The microprocessor then condenses the digitized data stream by removing any data not included in the identified data code word. Subsequently, the microprocessor stores the condensed digitized data in its non-volatile memory (NVM). When a switch associated with a particular channel is actuated, the microprocessor responds by transferring the data from its NVM to its RAM and generating an output data signal by reading the data from its RAM at the same rate at which it sampled the signal during the training mode. Provided this sampling rate is high enough, this technique is sufficient to acquire and store any received data signal without having to separately identify any pulse length or pulse frequency of the binary data included in the data signal. Thus, the microprocessor effectively operates as a digital recorder to record the signal in much the same manner that a computer stores a speech signal received through a connected microphone.

To further reduce the amount of NVM required to store a digitized data signal, a compression technique was developed by the inventor whereby, once the digitized data signal had filled the RAM of the microprocessor and had been condensed using the condensing routine described in the above patents, the condensed digitized data signal is then further processed by detecting patterns in the data signal, establishing templates for each identified pattern, and by storing a sequence identifying the sequential order in the digitized data signal in which the data in the signal corresponds to the established templates. More specifically, after the digitized data signal filling the microprocessor RAM had been condensed, the processor detects the first rising edge in the data signal (i.e., the first transition from a "0" value to a "1" logic value) and then counts the number of samples that are continuously at the "1" value. As shown in FIG. 1, each template is allocated 5 bytes. Each byte may take a hexadecimal value of "0" to "FF" for counts at a logic "1" or a value of "0" to "7F" for counts at a logic "0." The value stored in each byte represents the number of continuous samples at a particular binary logic value. Thus, as shown in the first two bytes of the first template, in the exemplary data code shown in FIG. 2, there are "FF"+4 (i.e., 300) samples at the binary value "1" for the first pulse of data. Because the value stored in the second byte is less than "FF," it may be determined that a sample at a "0" logic value was detected after "FF"+4 samples at a logic "1" value. Hence, the next byte in the first template is used to store the number of samples at the "0" logic value. If there are more than "7F" samples at the "0" value, the third byte of the first template is filled with "7F" and the count is continued and filled into the next byte and possibly even the next byte. If a logic "1" is detected in the digitized data signal before the last byte of the template has been filled (i.e., such that the value in the fourth byte of the first template is less than "7F"), the last byte is filled with "00" and the number of samples at the logic "1" value are recorded in the next template.

Up to fifteen templates of this type may be stored in memory and each is assigned an ID value in sequence of "0" to "F," such that each template has its own unique identifier. Clearly, the first template will correspond to the first portion of the data signal and thus a value of "0" is stored in a template sequence portion 10 of the memory for the channel. As the microprocessor counts the number of samples at any given logic value, it compares the number of counted values to the number of counted values for templates that have already been defined. If a portion of the data being analyzed already corresponds to a defined template, the microprocessor does not create a new template, but rather simply stores the identifier of the corresponding previously-defined template in the template sequence portion 10 of the allocated memory. The microprocessor thus continues analyzing each portion of the condensed digitized data signal until the entire portion of the digitized signal has been encoded in this manner.

Subsequently, upon receiving an instruction to transmit the stored encoded data signal, the microprocessor sequentially reads the sequence of template identifiers stored in the template sequence portion 10 of the memory. The microprocessor subsequently uses these identifiers to access the identified templates in the order in which the microprocessor had stored the template identifiers during the training mode. Thus, for example, in the example illustrated in FIG. 1, the microprocessor would read the first byte of the first template and generate a digital logic "1" value for a count of 256 (FF) clock pulses generated at the same sampling rate at which the signal was digitized and then subsequently read the second byte of data in the first template and determine that it must generate four more counts at logic "1" at that sampling rate. Then, having detected that the value read from one of the bytes is less than "FF," the microprocessor begins to generate a logic "0" value for the number of counts identified in the remaining bytes of the template.

Although the above-noted data signal encoding technique works satisfactorily for essentially all garage door opening mechanisms sold in the United States, certain garage door opening systems used in Europe transmit and receive data codes of lengths that are too long to store in the NVM of the microprocessor even while using the above data storage technique. Even more problematic is that these data codes are also too long to store in the microprocessor's RAM. When the data code word is too long to fit within the microprocessor's RAM, the microprocessor cannot learn and store an entire code word, and hence cannot subsequently transmit the proper data code to which the remotely controlled device would respond. Therefore, there exists a need for not only a more efficient data compression encoding algorithm, but also a compression algorithm that can be performed in real time as the received data signal is digitized and stored in a microprocessor's RAM so that an entire data code word can be effectively stored in the microprocessor's RAM and in its NVM for subsequent transmittal.

SUMMARY OF THE INVENTION

Accordingly, it is an aspect of the present invention to solve the above problems by providing the data compression algorithm that may be performed in real time as a digitized data signal is filling the RAM of a microprocessor. It is a further aspect of the present invention to provide a data signal compression algorithm that is capable of more efficiently compressing a data signal. An additional aspect of the present invention is to provide an adaptive data digitization and compression technique that may utilize a plurality of different sampling rates. Still another aspect of the present invention is to provide a compression algorithm that efficiently compresses data signals having extended "dead times" (i.e., long periods at a logic level "0").

To achieve these and other aspects and advantages, the data storing method of the present invention comprises the steps of: (a) receiving a data encoded signal; (b) sampling the received data encoded signal at a first sampling rate; (c) counting the number of consecutive samples at a first logic level; (d) storing the number of samples counted in step (c) in a first portion of a memory template; (e) counting the number of consecutive samples at a second logic level; (f) comparing the number of samples counted in step (e) to a threshold value; (g) changing the sampling rate at which the received data encoded signal is sampled and counting the number of consecutive samples at the second logic level if the number of samples counted in step (e) exceeds the threshold value; and (h) storing in the memory template, the number of samples counted in step (e) if the threshold was not exceeded, or the number of samples counted in step (g) if the threshold value was exceeded. An apparatus constructed in accordance with the present invention includes a processor programmed to perform the above steps.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
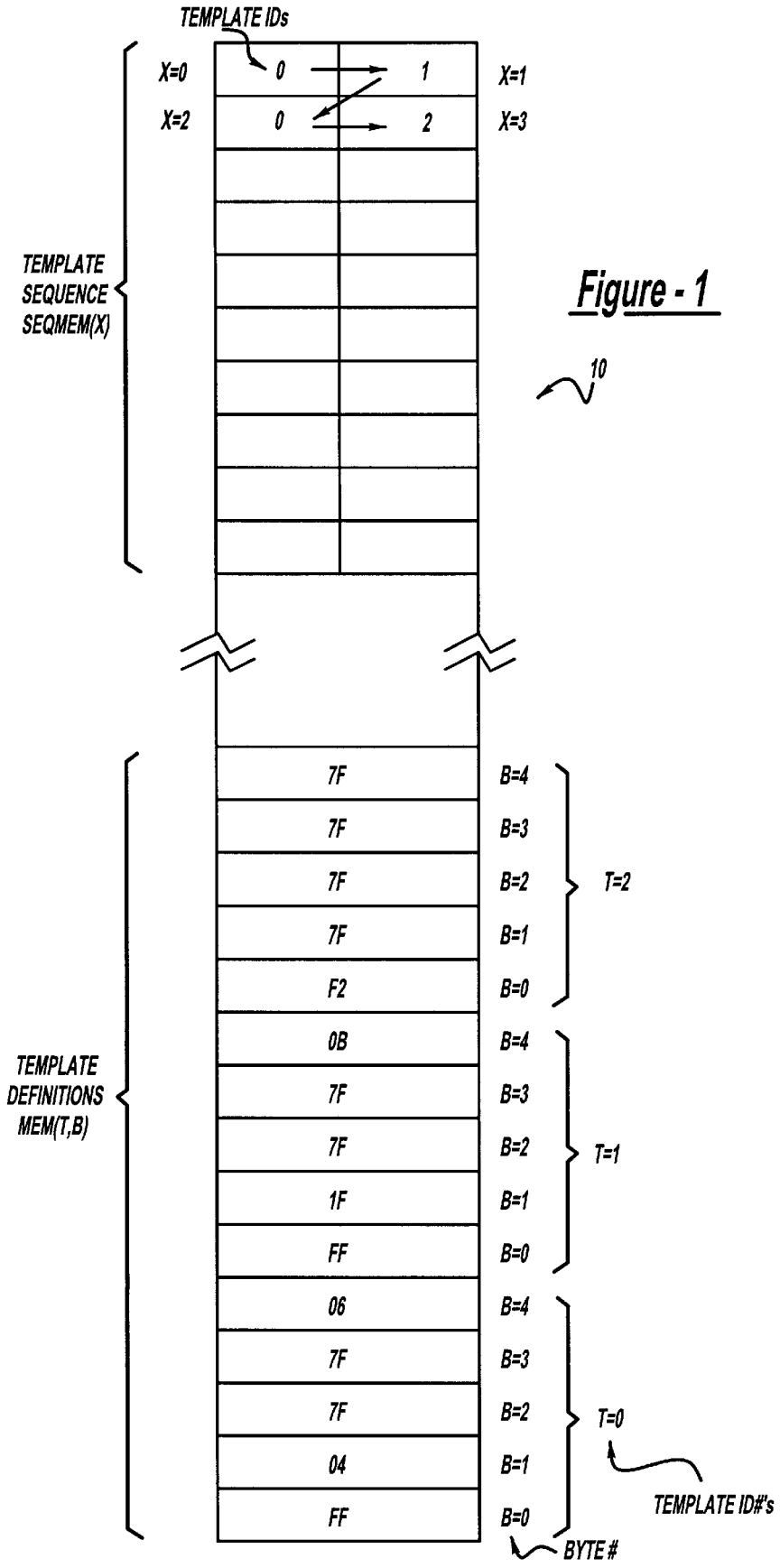
FIG. 1 is a diagram illustrating the contents of a memory of a conventional trainable transmitter.

The data storing technique of the present invention may be implemented in any trainable transmitter including both IR and RF trainable transmitters. Insofar as the data storing technique of the present invention was particularly designed for use in an RF trainable transmitter, a brief description of the general operation of an RF trainable transmitter is provided below.

The trainable RF transmitters described in the above-identified patents generally include an antenna 102 used to receive original signals "B" from original remote transmitters 104 during a training mode and for transmitting signals "T" to remotely actuated devices 106 during an operating mode. It will be appreciated by those skilled in the art that separate antennas may be used for transmitting and receiving these RF signals. Antenna 102 is coupled to a mixer 108, which, during the training mode, mixes the received RF signal "B" with a reference signal generated by a voltage controlled oscillator (VCO) 110. The frequency of the reference signal generated by VCO 110 is selectively controlled by a microprocessor 120 via a phase-locked loop circuit 112. Phase-locked loop circuit 112 is coupled to a frequency control terminal 113 of VCO 110 and coupled to the output of VCO 110 to monitor the frequency of the output reference signal.

The output of mixer 108 is passed through a bandpass filter 122. Bandpass filter 122 serves to block all the signals output from mixer 108 except for signals having a predetermined frequency. Signals having this predetermined frequency are only output from mixer 108 when the difference between the frequency of the reference signal generated by VCO 110 and the frequency of the received RF signal "B" is 455 kHz. The output of the bandpass filter 122 is then processed by a processing circuit 124 including an amplifier and an integrator, and then applied in a data input port 121 of microprocessor 120. The data output from processing circuit 124 may be similar to that shown in FIG. 2.

During the training mode, microprocessor 120 varies the frequency of the VCO 110 in a step-by-step manner until it detects data at its data input port 121. Because the frequency control signal output by microprocessor 120 has a different digital value for each frequency to be generated by VCO 110, microprocessor 120 can store the digital value of the frequency control signal at that time that data is detected at data input port 121. This stored digital value thus corresponds to the carrier frequency of the received RF signal and can therefore be used when the trainable transmitter is required to transmit a signal having the characteristics of the learned RF signal.

When microprocessor 120 detects the presence of data at data input port 121, it performs the compression algorithm described in more detail below, to compress and store the input data in its RAM 126 and NVM 128. To initiate training of one of the channels within trainable transmitter 100, a user actuates one of switches 144, 146, or 147 that corresponds to the channel in which the signal characteristics are to be stored. If the user continuously depresses one of switches 144, 146, and 147 for a predetermined period of, for example, five seconds, microprocessor 120 detects such actuation through a switch interface 140 and responds by entering a training mode and causing light emitting diode (LED) 150 to begin blinking. By blinking LED 150, microprocessor 120 signals the user to begin transmitting an original signal "B" from original remote control transmitter 104. Microprocessor 120 then steps through each of the frequencies that may correspond to the carrier frequency of original signal "B" in the manner generally described above. A more detailed discussion of this training procedure is disclosed in the above-identified patents. Once microprocessor 120 has detected data at its data input terminal 121, it stores the digital value representing the frequency of the reference signal generated by VCO 110 in the channel memory associated with the switch that the user actuated. The received data is then processed as discussed below and stored in a portion of NVM 128 associated with the actuated switch.

When a user subsequently wishes for the trainable transmitter 100 to transmit a signal "T" to a remotely controlled device 106, the user actuates one of switches 144, 146, and 147 associated with the signal that will in turn actuate remotely controlled device 106. Microprocessor 120 detects the actuation of the switch and reads from memory the stored digital frequency control value, which it supplies to VCO 110 through phase-locked loop circuit 112. Microprocessor 120 transfers the data code word stored in NVM 128 in association with the actuated switch into RAM 126. Microprocessor 120 then decompresses and decodes the stored data code word and outputs it to a data input terminal 111 of VCO 110, which effectively modulates the signal generated by VCO 110. This amplitude-modulated signal output from VCO 110 is amplified by amplifier 152 and transmitted through antenna 102 as an RF signal "T" to remotely controlled device 106.

As disclosed in the above-identified patents, such an RF trainable transmitter may be physically and permanently incorporated within a vehicle accessory, such as a sun visor, overhead console, or rearview mirror. If trainable transmitter 100 is permanently located within a vehicle accessory, it will typically include a power supply circuit 130 having a plug 132 for connecting power supply circuit 130 to the vehicle's battery 134. Thus, the trainable transmitter may be powered directly from the vehicle's battery rather than from a separate battery that would require replacement. Further, by providing a plurality of switches 144, 146, and 147, and an equal number of channels within the memory of the trainable transmitter, the transmitter may be trained to learn a plurality of different signal characteristics and thereby selectively remotely control a plurality of different devices.

Figure 2:
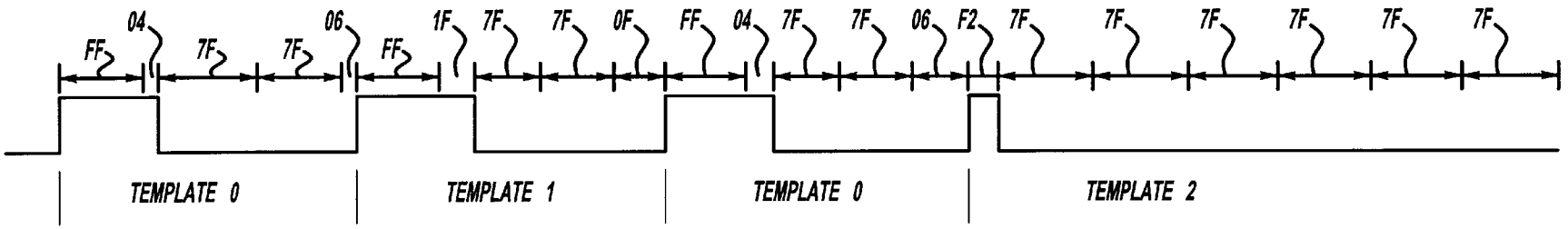
FIG. 2 is a diagram representing an exemplary data code signal of the type typically received by a controller in a trainable transmitter.
Figure 3:
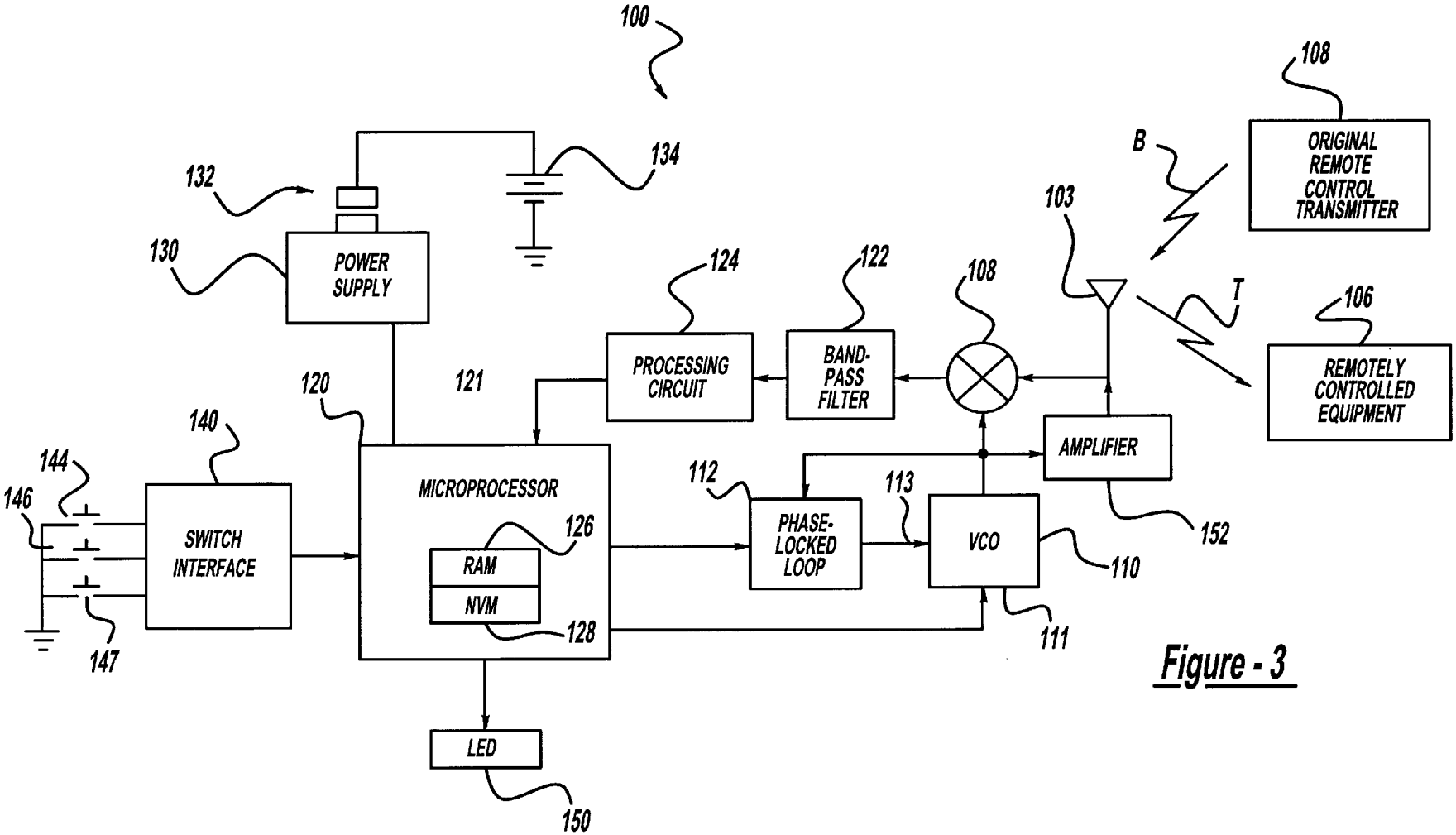
FIG. 3 is a schematic diagram in block form of a trainable transmitter constructed in accordance with the present invention.

Having explained generally the operation of an RF trainable transmitter, the improved data code compression process is described below with reference to the flowcharts shown in FIGS. 4A–4C, the memory map shown in FIG. 5, and the illustration of an exemplary data signal shown in FIG. 2.

Figure 4A:
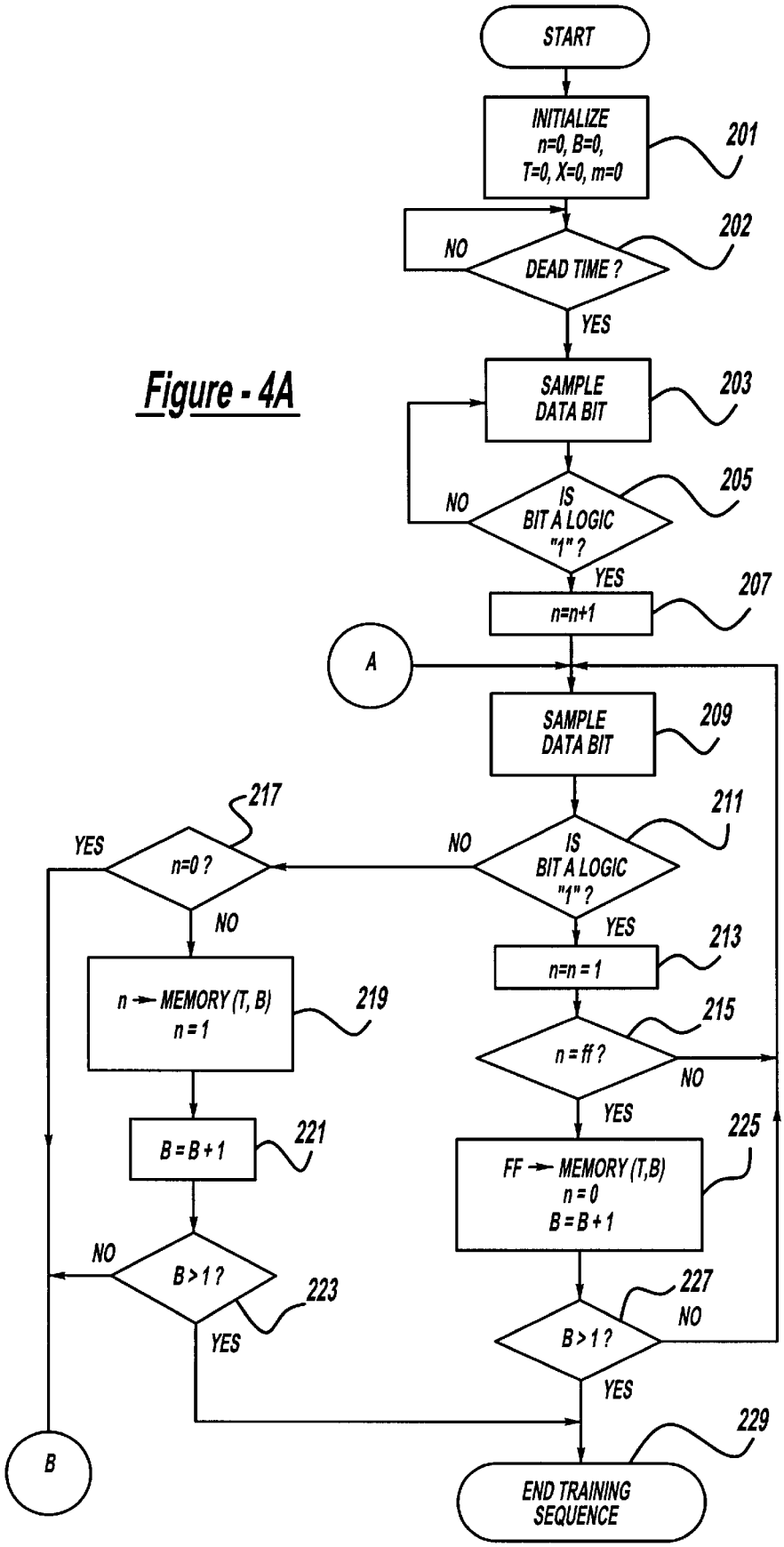
FIGS. 4A–4C are flowcharts of the data compression technique implemented in the trainable transmitter of the present invention.
Figure 4B:
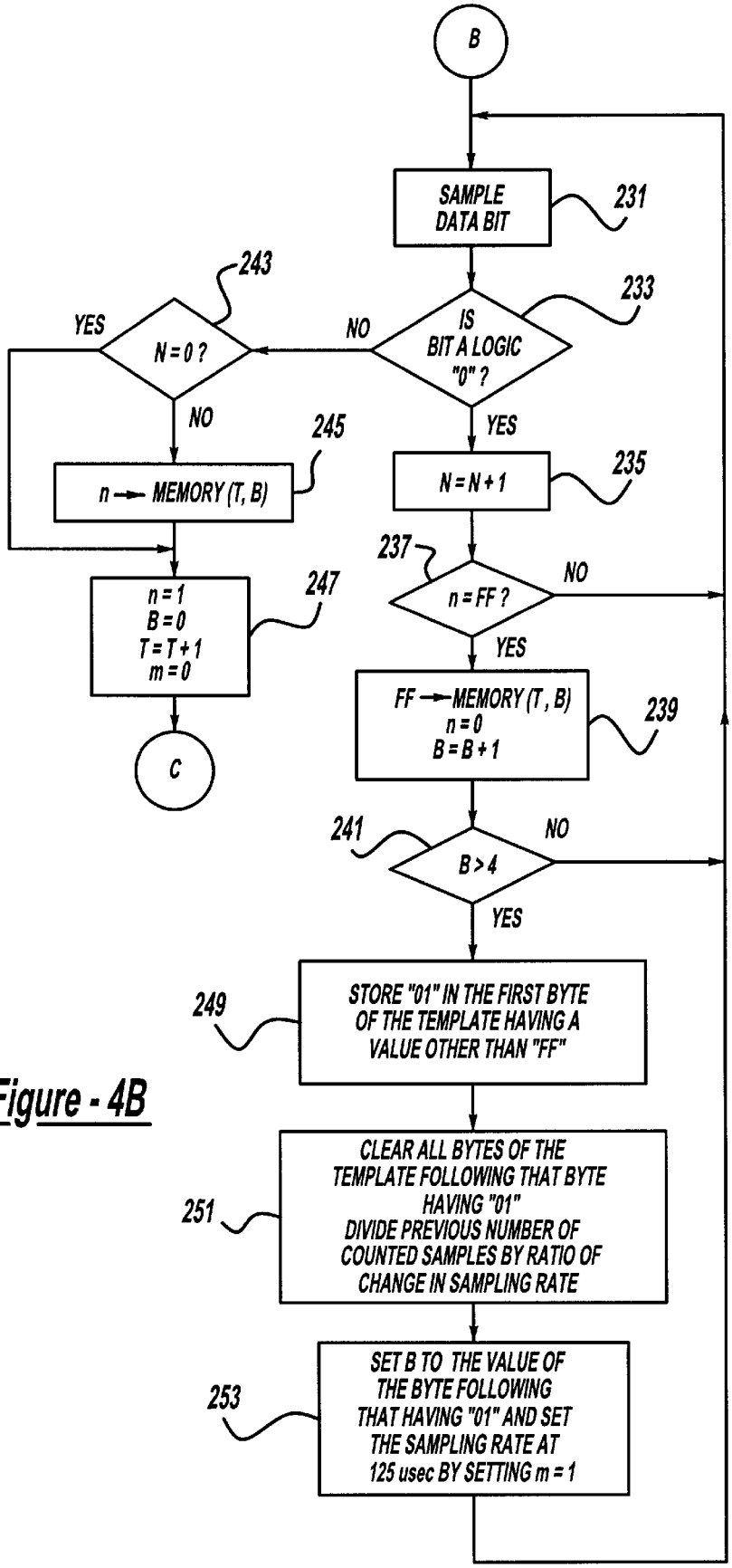
Figure 4C:
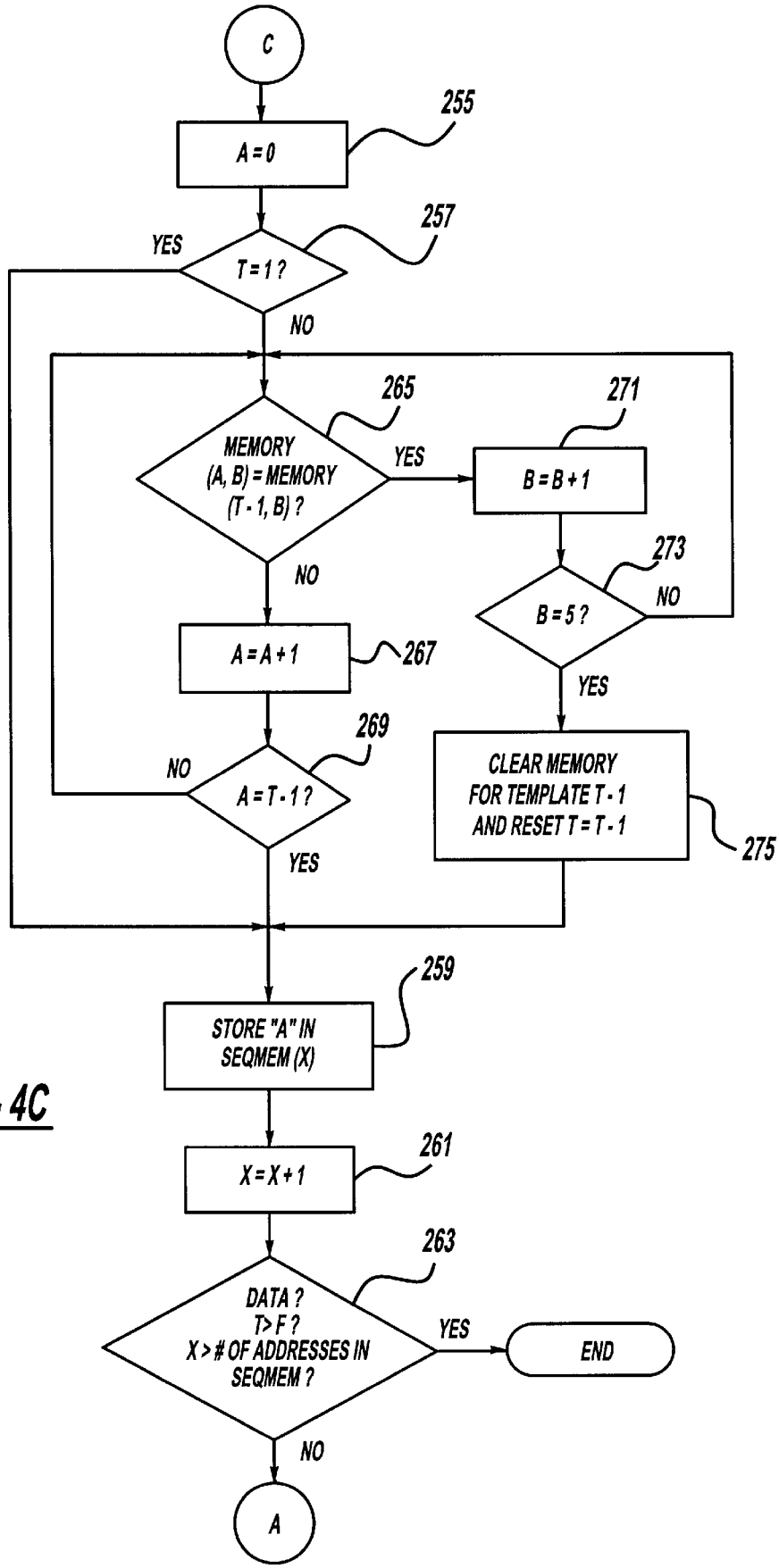
Figure 5:
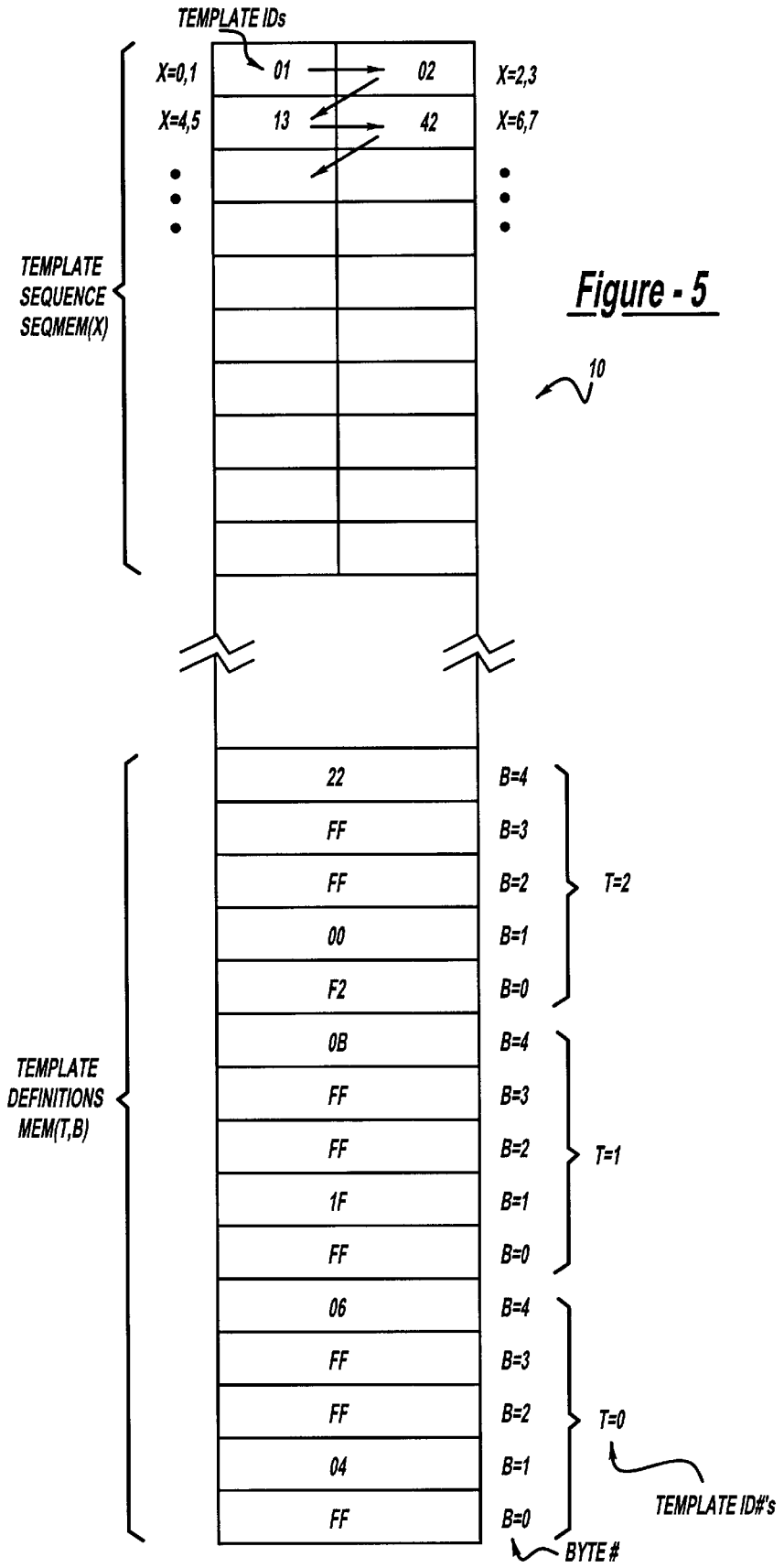
FIG. 5 is a diagram representing the contents of the memory of a trainable transmitter constructed in accordance with the present invention.

Once microprocessor 120 has identified the carrier frequency of the received RF signal during the training mode, it initiates a routine similar to that shown in FIGS. 4A–4C. The first step 201 in the routine is to initialize certain pointers and other parameters by setting them to "0." The first parameter "n" is used to count data samples at a particular logic value. The second parameter "B" is used to point to different bytes within the templates. A third parameter "T" is a pointer used to point to various templates in the memory. A fourth parameter "X" is used to point to positions in the template sequence portion of the memory, and parameter "m" is a flag used to determine the sampling rate at which microprocessor 120 is to sample the data signal appearing at its data input port 121.

After the above parameters have been initialized, microprocessor 120 monitors the data at input 121 until it detects a period of "dead time" (i.e., long periods at logic level "0") (step 202). Once microprocessor 120 has detected the end of the "dead time," it begins sampling the received data signal by sampling a first bit (step 203). As will be explained in greater detail below, this sampling is performed by comparing the analog value applied to the data input port 121 with a threshold level to determine whether the signal is at a logic "1" or logic "0" value at that particular instant in time. The sampling is preferably initially performed at 25 μsec. In step 205, microprocessor 120 then determines whether the sampled data bit is a logic "1." If it is not, microprocessor 120 samples the next data bit (step 203). If this next data bit is not a logic "1," microprocessor 120 continues to loop through steps 203 and 205 until a sampled data bit is at a logic "1" level.

When a logic "1" value is initially detected in step 205, microprocessor 120 performs step 207 by incrementing the value of data bit counter "n" to indicate that one sampled data bit was detected at a logic level "1." Next, microprocessor 120 samples another data bit (step 209) and checks to determine whether the sampled data bit is at a logic "1" value (step 211). If this next sampled data bit is at a logic "1," microprocessor 120 proceeds to step 213 where it again increments the value of "n" to indicate that another consecutive data bit is at a logic "1" level. Microprocessor 120 then checks whether the value of counter "n" has reached "FF" (i.e., 256), which is the highest counter value that may be stored in a byte within any one template. So long as microprocessor 120 subsequently samples and detects data bits having a logic value of "1," it continues to loop through steps 209, 211, 213, and 215 and counts the number of such data bits until either a data bit is detected that has a logic level of "0," or the number of consecutive data bits at logic level "1" exceeds hexadecimal value "FF."

If the value of "n" reaches "FF," microprocessor 120 writes the hexadecimal value "FF" into memory at location MEM (T,B), which initially is MEM (0,0) corresponding to the first byte in the first template (step 225). Microprocessor 120 also resets the value of "n" to "0" and increments the value "B" to point to the next byte in the template. Provided "B" is not greater than 4 (step 227), microprocessor 120 returns to step 209 to sample the next data bit and determines whether it is at a logic level "1" in step 211. Microprocessor 120 then continues to count the number of consecutive sampled data bits that are at a logic "1." If microprocessor 120 should subsequently determine that "B" is greater than 1 in step 227, it recognizes that an error has occurred and indicates an error message to the user prior to terminating the training sequence.

If microprocessor 120 detects a sampled data bit having a logic level equal to "0" prior to filling up all the bytes within the first template, microprocessor 120 checks whether the value of "n" is equal to "0" in step 217. If the value of "n" is not equal to "0," microprocessor 120 stores the last value of "n" in MEM (T,B) and then sets "n" equal to "1." If "n" is equal to "0," microprocessor 120 does not store the value of "n" in memory but proceeds directly to step 231 (FIG. 4B) to begin counting the number of consecutive sampled data bits at logic level "0." It is contemplated that microprocessor 120 would only determine that "n" is equal to "0" in step 217 if a "0" logic bit were detected immediately following the writing of "FF" in the preceding byte as indicating "FF" sampled data bits at the logic "1" level just prior to the detection of a "0" bit. Otherwise, "n" would have a value other than "0" that would be less than "FF" but greater than "0," which should be written into the next byte of the template. Thus, for example, given the data signal shown in FIG. 2, this algorithm would initially count "FF" data bits at logic "1" level and write "FF" into MEM (0,0), and then count n=04 detections of subsequent data bits at logic "1" prior to the detection of a data bit at logic level "0." Thus, microprocessor 120 would write "04" in MEM (0,1) (i.e., the next byte of the first template).

If microprocessor 120 writes the counted value of "n" in memory in step 219, it then increments the value "B" to point to the next byte in the template (step 221). If the value of "B" is not greater than 1, microprocessor 120 proceeds to step 231 to count the number of "0" logic bits. Otherwise, microprocessor 120 determines in step 223 that an error has occurred and terminates the training sequence.

In step 231, microprocessor 120 begins the process of counting the consecutive sampled data bits at logic level "0." Microprocessor 120 begins this process by sampling the next data bit in step 231, and checking to determine whether the sampled data bit is at a logic level "0" in step 233. If this sampled data bit is at a logic level "0," microprocessor 120 increments the value "n" in step 235 and checks whether the value of "n" has reached hexadecimal value "FF" in step 237. If "n" is not equal to "FF," microprocessor 120 repeats steps 231–237 until either a sampled data bit is detected that has a logic level of "1" or microprocessor 120 determines that "n" is equal to "FF." If "n" is equal to "FF," microprocessor 120 writes "FF" into MEM (T,B) in step 239, and resets counter "n" to "0" and increments byte pointer "B." Then, provided that byte pointer "B" is not greater than 4 (step 241), microprocessor 120 continues to count consecutive sampled data bits at logic level "0" by looping through steps 231–241. If, however, a sampled data bit is detected that is at a logic "1" in step 233 prior to counting "FF" data bits at logic "0" for the last byte of the template, microprocessor 120 advances to step 243 where it checks whether the last value of "n" is equal to "0." If "n" is not equal to "0," microprocessor 120 writes the value of "n" into MEM (T,B) and advances to step 247. Otherwise, if "n" is equal to "0," microprocessor 120 does not write this "0" value into memory, but skips step 245 to advance to step 247 where microprocessor 120 sets the value of "n" equal to "1," "B" equal to "0,""m" equal to "0," and increments the template pointer "T" prior to advancing to step 255 (FIG. 4C).

If, in steps 237 and 241, microprocessor 120 determines that counter "n" is equal to "FF" and that the byte pointer "B" is greater than 4, microprocessor 120 then assumes that there are additional subsequent samples that may be at logic level "0." However, because there are no bytes left in the template in which to store count values of any additional sampled bits at logic level "0" and because each template begins with the rising edge of a pulse that occurs from a transition of a logic level "0" to a logic level "1," the counting of additional logic levels "0" cannot span from one template into the next template. Further, because some of the RF control signals transmitted by European-made original garage door transmitters include significant amounts of "dead time" between code words (i.e., extended periods at logic "0"), the present invention provides a means for detecting the presence of such "dead time." When such "dead time" is detected, microprocessor 120 slows down the sampling rate of the microprocessor during this dead time so as to more efficiently compress the received data signal and thereby allow all of the dead time to be effectively recorded within a template.

To carry out these functions, microprocessor 120 recognizes when the last byte of the template is being defined and when the count value of logic "0's" for this last byte of the template has reached the hexadecimal value of "FF." When this occurs, microprocessor 120 executes step 249 in which it identifies the first byte of the template having a value of "FF" following a byte having a value other than "FF." In other words, this byte is that which follows the byte defining the tail end of a logic "1" pulse. Microprocessor 120 then writes over the "FF" stored in the identified byte placing "01" therein which is considered an invalid entry. Then, in step 251, microprocessor 120 clears all the bytes of the template following that byte in which it wrote "01" so that they may be overwritten with the calculated value of the number of samples taken at the slower rate. In step 253, microprocessor 120 sets the byte pointer "B" to the value of the byte following that having "01," sets the sampling rate at a slower rate (preferably at 125 μsec) by setting the flag "m" equal to "1," and calculates the number of samples already counted at the different rate by dividing the number of "0" logic samples counted at the faster rate by five (the factor by which the sampling rate is changed) and resuming counting at the slower rate starting from the calculated number of samples. Microprocessor 120 then loops back through steps 231–241 to count the number of samples at the logic level "0" at the slower sampling rate.

As will be appreciated by those skilled in the art, the rate at which microprocessor 120 samples the data signal applied to data input terminal 121 may be changed by providing a latch circuit to latch and hold the level of the data signal at the latest clock pulse that is also applied to the latch circuit such that the frequency of the clock may be adjusted to change the sampling rate. Alternatively, delays may be programmed into the software routine such that the sampling steps are performed at the appropriate intervals of time and wherein additional delays may be executed between sampling steps if the flag "m" has been set.

Microprocessor 120 then continues to count the bits sampled at the slower rate until a bit having a logic "1" is subsequently detected in step 233. If a logic "1" bit is detected, microprocessor 120 proceeds to step 243 in the manner described above.

As noted above, when either all of the bytes of a template have been filled or when a bit having a logic "1" is detected following a sequence of detected logic "0" bits, the template pointer is incremented such that the next template may be defined by again counting the number of sampled bits at each logic value. Because some of the templates defined may have identical definitions due to patterns in the data that are repeated, microprocessor 120 compares the definition of the most recently defined template with the definition of all the previously-defined templates to determine whether that particular data pattern defined by the latest template has already been defined so that it will not waste memory storing duplicate template definitions. The present invention differs from the prior method in that two template IDs are stored per byte of the template sequence portion of the memory, thereby further reducing the amount of memory required.

To ensure the proper reconstruction of the signal based upon the defined templates, the sequence of the data patterns defined by these templates in the order they appear or reappear must also be stored in memory. Thus, each time a template has been defined using the routine shown in FIGS. 4A and 4B, a template ID number is stored in a portion of the memory allocated to the channel in the NVM 128. Microprocessor 120 performs this operation by executing the routine generally outlined in FIG. 4C. This routine begins by setting parameter "A" to "0" in step 255, which is used to sequence through and point to each of the previous templates that had been defined. Next, in step 257, microprocessor 120 checks whether there are any predefined templates by checking whether "T" is equal to "1." If "T" is equal to "1," there are no previous templates and microprocessor 120 advances to step 259 where it stores the value of "A" in the template sequence portion of the memory SEQMEM(X). The pointer "X" is then incremented in step 261 to point to the next location in the template sequence portion of the memory. Then, in step 263, microprocessor 120 checks whether there is any data left to compress or whether all of the templates have been defined (sixteen templates may be defined) or whether the value of the pointer "X" exceeds the number of memory locations in the template sequence portion of the memory. If any of these conditions are met, microprocessor 120 ends the routine. Otherwise, microprocessor 120 returns to step 209 (FIG. 4A) to begin sampling data bits for the next template.

If, in step 257, microprocessor 120 determines that "T" is not equal to "1," it assumes that at least one previously-defined template does exist. In step 265, microprocessor 120 compares the values stored in the first bit of the first defined template (i.e., stored in MEM (A,B)) with the value stored in the first byte of the most recently defined template. If these compared values are not equal, microprocessor 120 increments pointer "A" to point to the next defined template in step 267, and then determines whether the next defined template is, in fact, the most recently defined template by checking whether "A" is equal to T−1 in step 269. If the value of pointer "A" is equal to T−1, microprocessor 120 stores the value of "A" in the Xth position in the template sequence portion of the memory (SEQMEM(X)) in step 259. On the other hand, if, in step 265, microprocessor 120 determines that the value stored in the first byte of the first template is the same as the value stored in the first byte of the most recently defined template, microprocessor 120 increments the byte pointer "B" in step 271. If the value of byte pointer "B" has not yet reached 5 (step 273), microprocessor 120 continues to compare the values stored in each of the bytes of the first defined template and the most recently defined template. If microprocessor 120 reaches step 273 when "B" is equal to 5 meaning that all the values of each byte of the two compared templates are equal, microprocessor 120 advances to step 275 where it clears the memory for the most recently defined template T−1 and resets the value of template pointer "T" to T−1 so as to allow the allocated memory for template T−1 to be subsequently used to define the next template. Microprocessor 120 then stores the value "A" in the Xth memory location in the template sequence portion of the memory (step 259).

As evident from the above descriptions of the data storage technique of the present invention and the data storage technique used prior to the invention, the present invention can effectively accommodate long periods of "dead time" that often appears in signals transmitted by European garage door opener transmitters. If a trainable transmitter using the prior data storage technique were to receive such a signal, its RAM would become over-filled with data that the trainable transmitter would be unable to store an entire code word thereby resulting in a failure to learn the requisite data code for subsequent transmission. The present invention, on the other hand, encodes the received data signal as it receives and samples the signal. Thus, an entire digitized data code word need not be stored in the processor's RAM. Further, by changing to a slower sampling rate when a threshold number of consecutive logic "0" data samples are counted, a trainable transmitter employing the data storage technique of the present invention may more effectively compress the encoded data when a long period of "dead time" is present in the data signal.

Although the present invention has been described as having been primarily developed for use in an RF trainable transmitter to overcome the above-noted problems, it will be apparent to those skilled in the art that the data storage technique of the present invention may also be used for other trainable devices such as an IR universal remote control transmitter. Further still, it will be apparent to those skilled in the data storage art that the methodology of the present invention may be used in other applications in which a data signal must be stored.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. A trainable transmitter comprising:

a receiver for receiving a data encoded signal transmitted from an original transmitter;

a memory device;

a control circuit coupled to said receiver and said memory device for storing the data encoded signal in said memory device by performing the steps of:

(a) sampling the received data encoded signal at a first sampling rate, (b) counting the number of consecutive samples of the data encoded signal that are at a first logic level, (c) storing the number of samples counted in step (b) in a first portion of a memory template in said memory device, (d) counting the number of consecutive samples of the data encoded signal that are at a second logic level, (e) comparing the number of samples counted in step (d) to a threshold value, (f) changing the sampling rate at which the data encoded signal is sampled and counting the number of consecutive samples at the second logic level if the number of samples counted in step (d) exceeds the threshold value, and (g) storing in a second portion of the memory template, the number of samples counted in step (d) if the threshold was not exceeded, or the number of samples counted in step (f) if the threshold value was exceeded; and a transmitter coupled to said control circuit for receiving and transmitting the data encoded signal as said control circuit reads the signal from said memory device, wherein said memory device includes a plurality of uniquely defined templates that are defined by the stored numbers of counted samples, each of said plurality of uniquely defined templates having a unique template identification number associated therewith, said memory device further includes a template sequence portion in which unique template identification numbers are stored in the sequence in which the samples defining such templates appear in said data encoded signal.

2. The trainable transmitter as defined in claim 1, wherein said receiver is an RF receiver and said data encoded signal is an RF signal.

3. The trainable transmitter as defined in claim 1, wherein said control circuit is further adapted to (h) store in said memory device, a unique template identification number associated with the memory template into which the numbers of samples stored in steps (c) and (g) have been stored.

4. The trainable transmitter as defined in claim 1, wherein said control circuit is further adapted to repeat steps (a)–(g) and determine whether the stored numbers of samples correspond to the stored numbers of samples of a previously defined template, and, if there is no correspondence, storing a unique template identification number for the newly defined template in the template sequence portion of said memory device, and, if there is a correspondence to a previously defined template, storing the unique template identification number of the corresponding template in the template sequence portion of said memory device.

5. The trainable transmitter as defined in claim 4, wherein said control circuit reads the data encoded signal from said memory device by performing the steps of:

(i) reading from the template sequence portion of said memory, a first template identification number;

(ii) reading from said memory device, the numbers of samples at the first and second logic levels as stored in the template identified by the read template identification number;

(iii) generating a data encoded signal having a first logic level maintained for a time period equal to the number of samples stored in the template for the first logic level divided by the sampling rate at which the number of samples were obtained;

(iv) generating a data encoded signal having a second logic level maintained for a time period equal to the number of samples stored in the template for the second logic level divided by the sampling rate at which the number of samples were obtained;

(v) reading from the template sequence portion of said memory device, the next of the sequentially stored template identification numbers; and (vi) repeating steps (ii) through (v) until all template identification numbers stored in the template sequence portion of said memory portion have been read.

6. The trainable transmitter as defined in claim 1 and further including a plurality of user-actuatable switches coupled to said control circuit, wherein said memory device is partitioned into a corresponding plurality of channel segments each including a template definition portion and a template sequence portion, said control circuit reads or writes data to/from one of said channel segments of said memory device when a corresponding user-actuatable switch has been actuated.

7. The trainable transmitter as defined in claim 6, wherein, when a user-actuatable switch has been actuated for at least a predetermined time period, said control circuit stores a data encoded signal in a corresponding one of said channel segments of said memory device, and, when a user-actuatable switch has been actuated for less than the predetermined time period, said control circuit generates a data encoded signal by reading data stored in the corresponding one of said channel segments.

8. The trainable transmitter as defined in claim 7, wherein said receiver is an RF receiver, said data encoded signal is an RF signal, and said control circuit identifies an RF carrier frequency of the received RF signal and stores data in said memory device that represents the identified RF carrier frequency.

9. The trainable transmitter as defined in claim 1, wherein said data encoded signal is a binary signal.

10. A method of storing a binary data signal comprising the steps of:

(a) receiving a binary data signal;

(b) sampling the received binary data signal at a first sampling rate;

(c) counting the number of consecutive samples of the binary data signal that are at a first logic level;

(d) storing the number of samples counted in step (c) in a first portion of a memory template;

(e) counting the number of consecutive samples of the binary data signal that are at a second logic level;

(f) comparing the number of samples counted in step (e) to a threshold value;

(g) changing the sampling rate at which the received binary data signal is sampled and counting the number of consecutive samples at the second logic level if the number of samples counted in step (e) exceeds the threshold value;

(h) storing in the memory template, the number of samples counted in step (e) if the threshold was not exceeded, or the number of samples counted in step (g) if the threshold value was exceeded; and (i) storing a unique template identification number associated with the memory template into which the numbers of samples stored in steps (d) and (h) have been stored.

11. The method as defined in claim 10 and further including the step of (j) repeating steps (b)–(i) and determining whether the stored numbers of samples correspond to the stored numbers of samples of a previously defined template, and, if there is no correspondence, sequentially storing a unique template identification number for the newly defined template, and, if there is a correspondence to a previously defined template, sequentially storing the unique template identification number of the corresponding template.

12. An apparatus including a memory device and a processor adapted to:

(a) receive a binary data signal;

(b) sample the received binary data signal at a first sampling rate;

(c) count the number of consecutive samples of the binary data signal that are at a first logic level;

(d) store the number of samples counted in step (c) in a first portion of a memory template of said memory device;

(e) count the number of consecutive samples of the binary data signal that are at a second logic level;

(f) compare the number of samples counted in step (e) to a threshold value;

(g) change the sampling rate at which the received binary data signal is sampled and counting the number of consecutive samples at the second logic level if the number of samples counted in step (e) exceeds the threshold value;

(h) store in the memory template, the number of samples counted in step (e) if the threshold was not exceeded, or the number of samples counted in step (g) if the threshold value was exceeded; and (i) store a unique template identification number associated with the memory template into which the numbers of samples stored in steps (d) and (h) have been stored.

13. The apparatus as defined in claim 12, wherein said processor is further adapted to repeat steps (b)–(i) and determine whether the stored numbers of samples correspond to the stored numbers of samples of a previously defined template, and, if there is no correspondence, sequentially storing a unique template identification number for the newly defined template, and, if there is a correspondence to a previously defined template, sequentially storing the unique template identification number of the corresponding template.

14. A trainable transmitter comprising:

a receiver for receiving a data encoded signal transmitted from an original transmitter;

a memory device;

a control circuit coupled to said receiver and said memory device for storing the data encoded signal in said memory device by performing the steps of:

(a) sampling the received data encoded signal at a first sampling rate, (b) counting the number of consecutive samples of the data encoded signal that are at a first logic level, (c) storing the number of samples counted in step (b) in a first portion of a memory template in said memory device, (d) counting the number of consecutive samples of the data encoded signal that are at a second logic level, (e) comparing the number of samples counted in step (d) to a threshold value, (f) changing the sampling rate at which the data encoded signal is sampled and counting the number of consecutive samples at the second logic level if the number of samples counted in step (d) exceeds the threshold value, and (g) storing in a second portion of the memory template, the number of samples counted in step (d) if the threshold was not exceeded, or the number of samples counted in step (f) if the threshold value was exceeded;

a transmitter coupled to said control circuit for receiving and transmitting the data encoded signal as said control circuit reads the signal from said memory device; and a plurality of user-actuatable switches coupled to said control circuit, wherein said memory device is partitioned into a corresponding plurality of channel segments each including a template definition portion and a template sequence portion, said control circuit reads or writes data to/from one of said channel segments of said memory device when a corresponding user-actuatable switch has been actuated.

15. The trainable transmitter as defined in claim 14, wherein, when a user-actuatable switch has been actuated for at least a predetermined time period, said control circuit stores a data encoded signal in a corresponding one of said channel segments of said memory device, and, when a user-actuatable switch has been actuated for less than the predetermined time period, said control circuit generates a data encoded signal by reading data stored in the corresponding one of said channel segments.

16. The trainable transmitter as defined in claim 15, wherein said receiver is an RF receiver, said data encoded signal is an RF signal, and said control circuit identifies an RF carrier frequency of the received RF signal and stores data in said memory device that represents the identified RF carrier frequency.

17. The trainable transmitter as defined in claim 14, wherein said data encoded signal is a binary signal.

18. A method of storing a data encoded signal, the method comprising:

(a) receiving a data encoded signal;

(b) sampling the received data encoded signal at a first sampling rate;

(c) counting the number of consecutive samples of the data encoded signal that are at a first logic level;

(d) storing the number of samples counted in step (c) in a first portion of a memory template;

(e) counting the number of consecutive samples of the data encoded signal that are at a second logic level;

(f) storing in the memory template, the number of samples counted in step (e); and (g) storing a unique template identification number associated with the memory template into which the numbers of samples stored in steps (d) and (f) have been stored.

19. The method as defined in claim 18 wherein receiving the data encoded signal includes receiving a binary data signal.

20. The method as defined in claim 18 wherein receiving the data encoded signal includes receiving a RF data signal.

21. The method as defined in claim 18 and further including the step of (h) repeating steps (b)–(f) and determining whether the stored numbers of samples correspond to the stored numbers of samples of a previously defined template, and, if there is no correspondence, sequentially storing a unique template identification number for the newly defined template, and, if there is a correspondence to a previously defined template, sequentially storing the unique template identification number of the corresponding template.

* * * * *